United States Patent [19]

Silvestri, Jr.

[11] Patent Number: 4,561,255

[45] Date of Patent: Dec. 31, 1985

[54] POWER PLANT FEEDWATER SYSTEM

[75] Inventor: George Silvestri, Jr., Maitland, Fla.

[73] Assignee: Westinghouse Electric Corp., Pittsburgh, Pa.

[21] Appl. No.: 507,608

[22] Filed: Jun. 24, 1983

[51] Int. Cl.[4] ..... F01K 7/34

[52] U.S. Cl. ..... 60/678; 60/679

[58] Field of Search ..... 60/678, 679, 680

[56] References Cited

U.S. PATENT DOCUMENTS 3,913,330 10/1975 Horlitz, Jr. ..... 60/678

*Primary Examiner*—Allen M. Ostrager

*Attorney, Agent, or Firm*—F. J. Baehr

[57] ABSTRACT

A feedwater heater system for a steam turbine power plant is provided which incorporates a liquid-to-liquid heat exchanger in addition to a plurality of vapor-to-liquid feedwater heaters. The advantage of this configuration is that the potential magnitude of entrained impurities within the feedwater stream is reduced without a significant increase in the overall heat rate of the steam turbine power plant. A preferred embodiment of the present invention incorporates three low pressure feedwater heaters and two high pressure feedwater heaters in conjunction with a drain cooler which is connected serially between the low and high pressure feedwater heaters. An alternative embodiment of the present invention incorporates a liquid-to-liquid heat exchanger connected hydraulically in parallel with the low pressure feedwater heaters. In both embodiments of the present invention, the liquid-to-liquid heat exchanger of the present invention receives the drain water from a reheater, such as a moisture separator-reheater, and exhausts this liquid to a condenser of the steam turbine power plant.

5 Claims, 8 Drawing Figures

POWER PLANT FEEDWATER SYSTEM

BACKGROUND AND SUMMARY OF THE INVENTION

The present invention relates generally to a steam turbine power plant and, more particularly, to a steam turbine power plant which incorporates a liquid-to-liquid feedwater heater in conjunction with a plurality of vapor-to-liquid feedwater heaters.

In a steam power plant, a plurality of feedwater heaters are usually employed to increase the temperature of a condensate taken from a condenser within the steam power system prior to reintroducing that condensate into a steam generator. By increasing the temperature of the condensate before it is reintroduced into the steam generator, the overall efficiency of the power plant is improved. It has been the practice in the art to heat the condensate in one or more feedwater heaters which use steam taken from extraction ports of a high pressure turbine element. Also, low pressure feedwater heaters can be employed in series with high pressure feedwater heaters between the condenser and the steam generator in order to provide gradual step increases in the temperature of the feedwater as it passes from the condenser to the steam generator. The steam which is used to raise the temperature of the feedwater is taken from the low and high pressure turbine elements through extraction ports. It is known in the art to also utilize the condensed throttle steam from the drain of a reheater such as a moisture separator-reheater.

When a plurality of feedwater heaters is used, each feedwater heater has a vapor inlet which is connected in fluid communication with an extraction port of one of the steam turbine elements. After this extracted steam passes in thermal communication with the feedwater within the feedwater heater, it condenses and is removed from the feedwater heater through a condensate outlet. It is known in the art to connect the condensate outlet of one feedwater heater to an inlet of a lower pressure feedwater heater within the system. This technique allows this condensate to flash within the lower pressured feedwater heater and, due to its higher temperature, help to increase the temperature of the feedwater passing through that lower pressure feedwater heater. When a plurality of feedwater heaters are connected in series, it is common practice for some of the feedwater heaters, except the one which is at the lowest pressure, to be cascaded backward, in a direction opposite to that of the feedwater flow, toward the condenser in this manner. Eventually, this condensate is introduced into the feedwater heater which is operating at the lowest pressure and, after raising the temperature of the feedwater passing through this low pressure feedwater heater, its condensate is introduced into an inlet port of a condenser. By utilizing systems of this type, much of the heat from the steam which is removed from the turbine extraction ports can be effectively transferred to the feedwater prior to its entry into the steam generator.

Another technique known to those skilled in the art is to introduce the condensate from one of the high pressure feedwater heaters directly into the stream of feedwater as it flows toward the steam generator. When this technique is utilized, this condensate from a high pressure feedwater heater is generally introduced upstream from a feedwater pump.

U.S. Pat. No. 3,973,402, which issued to Silvestri on Aug. 10, 1976, describes a pressure increasing ejector element which is disposed in an extraction line between a high pressure turbine element and a feedwater heater. The purpose of this ejector element is to increase the pressure at which the extraction steam is introduced into the feedwater heater by utilizing high pressure fluid from a reheater drain. U.S. Pat. No. 4,336,105 issued to Silvestri on June 22, 1982, describes a nuclear power plant steam system which utilizes steam from two extraction ports of a steam turbine in order to heat water in at least two feedwater heaters.

Feedwater heaters of many types are known to those skilled in the art. U.S. Pat. No. 3,795,273 which issued to Brigida et al. on Mar. 5, 1974 describes a feedwater heater designed for use in a power plant system in which steam from another unit in the system is introduced into the shell of the heater and the feedwater heater discharges condensate to another unit in the system. The Brigida patent describes a feedwater heater in which feedwater is circulated through tubes in the shell in thermal communication with the steam which is thereby condensed. Another portion of the steam is directed to an area of the shell where it warms the condensate to a degree that maintains the condensate at or near its saturation temperature.

U.S. Pat. No. 3,885,621 which issued to Slebodnick on May 27, 1975 discusses a vertically disposed feedwater heater which has an upper portion which is sealed by a water seal, thereby forming a vent condenser. This type of feedwater heater further comprises a plurality of telescoping skirts and a collar which cooperate to form this water seal.

U.S. Pat. No. 3,938,588 which issued to Coit et al. on Feb. 17, 1976 describes a feedwater heater which has a condensate inlet and a flow distributor which are cooperatively associated, a plurality of U-shaped tubes, a vent condenser portion and a centrally disposed trough within its tube bundle. The purpose of the Coit patent is to provide a feedwater heater which deaerates the condensate fluid.

U.S. Pat. No. 4,136,734 which issued to Sasaki et al. on Jan. 3, 1979 discloses a feedwater heater which has a hot steam inlet for introducing high temperature steam, such as a bleed from a steam turbine extraction port. It comprises a generally cylindrical body which is further provided with a condenser outlet for discharging steam condensate out of the feedwater heater unit. U.S. Pat. No. 4,207,842 which issued to Kehihofer on June 17, 1980 discloses a mixed flow feedwater heater which has a regulating device and a feedwater tank having a deaerating dome.

In typical nuclear power cycles, moisture separator-reheaters are used at the inlet portion of a low pressure turbine element in order to improve the cycle efficiency of the system and to reduce blade erosion which could be caused by entrained moisture in the steam. For lower pressure nuclear power plants which have essentially dry and saturated or low superheat steam at the throttle, this moisture separation occurs at the high pressure turbine exhaust. A moisture separator-reheater restores the steam to a dry and saturated condition. The moisture which is present in the steam entering the moisture separator-reheater is then removed from the steam flow and is conducted to a feedwater heater. Generally, this moisture separator-reheater drain water is introduced to the feedwater heater which is connected in fluid communication with the extraction port of a high turbine element. In some cases, it has been found necessary to cascade the drain water from the moisture separator-reheater to a lower pressure feedwater heater in order to insure positive separator drainage. U.S. Pat. No. 4,206,802 which issued to Reed et al. on June 10, 1980 discloses a moisture separator-reheater which incorporates a plurality of tube bundles which receive high pressure saturated steam therein. Steam which is to be reheated is passed in heat exchange relationship with the tubes of the first and second reheater tube bundles after first being dried by the panels of a moisture separator.

In nuclear power plants which utilize oncethrough steam generators, units which utilize pumped forward drains which have a water impurity inflow, such as units with demineralizers or with persistent condenser leakage, the impurity concentration of inlet steam and feedwater increases by the value of inflow for every circulation cycle and eventually reaches a limiting value. This problem occurs because most of the impurities from the high pressure turbine steam are concentrated in the separator drains. This concentration of impurities occurs because the solubility of impurities in water is several orders of magnitude higher than their solubility in steam. Furthermore, in the transition of steam with impurities from the dry to the wet phase in the high pressure turbine element, most of the water droplets form on impurity precipitates as nucleation centers and many impurities, such as sodium salts, are hygroscopic and therefore absorb moisture. One potential solution to this concentration problem which has been considered by those skilled in the art is to cascade all of the heater drains toward lower pressure feedwater heaters and eventually back to the condenser. Although this possible solution ameliorates the impurity concentration problem, it has a significant negative impact on cycle efficiency by increasing the heat rate by as much as 0.43%.

The present invention utilizes a heat exchanger which is interspersed between the feedwater heater which is connected to a high pressure extraction port and the next lower pressure feedwater heater. The heat rate in this type of configuration is improved by approximately 0.31% as compared to the alternative which cascades the condensate from all of the feedwater heaters to lower pressured feedwater heaters and eventually to the condenser. The liquid-to-liquid heat exchanger of the present invention receives the water from the moisture separator drain of the moisture separator-reheater and then cascades it to the next lower pressure feedwater heater. The heat exchanger utilized in the present invention can be similar, in operation, to a drain cooler. Although the present invention can have a heat rate which is poorer than a system which incorporates total reverse cascading, it is not subject to the concentration of impurities which would otherwise be present. The present invention reduces the impurity concentrating mechanism of other alternative configurations while minimizing the heat rate loss as compared to other alternatives. Furthermore, the present invention avoids the necessity of increasing the condensate flow capability of the low pressure feedwater heaters which would otherwise be necessitated if all feedwater heaters were cascaded back toward lower pressure feedwater heaters. This characteristic is especially important in situations where an existing power plant is to be retrofitted. If all of the feedwater heaters of the plant were to be reconnected in order to convert to a totally cascading cycle, the lower pressure feedwater heaters would experience a condensate flow increase of approximately 45%. It is highly probable that these lower pressure feedwater heaters could not be operated with this additional condensate flow. If the present invention is utilized to retrofit an existing power plant, the lower pressure feedwater heater condensate flow would increase only by approximately 16%.

The water received from the separator drain of a moisture separator-reheater will typically have a comparatively high contaminant level as compared to the steam received from the extraction ports of the high and low pressure turbine elements. This drain water from the moisture separator-reheater would not pass through a condensate demineralizer, which would be located in the lowest temperature end of the condensate stream, to purify it. During each pass of the water through the condenser and steam generator system, there would be an increase in the contaminant level in the condensate which enters the steam generator and the steam which leaves the steam generator. Furthermore, the volume of drain water being cascaded through the low pressure feedwater heaters may be beyond the capacity of these heaters to function properly. This condition may cause flooding of the low pressure feedwater heaters and any flooding of a feedwater heater will impair its ability to transfer heat, resulting in an increase of the heat rate.

A typical embodiment of the present invention would incorporate three low pressure feedwater heaters in which two of the feedwater heaters are cascaded backward so that their condensate flows into the next lower feedwater heater. The lowest pressure feedwater heater would then pass its condensate to the condenser. A water-to-water heat exchanger would be connected to the separator drain of a moisture separator-reheater and the drain water outlet of this water-to-water heat exchanger would be connected in fluid communication to an inlet of the highest of the three low pressure feedwater heaters. The feedwater would pass serially through the three low pressure feedwater heaters and then through the water-to-water feedwater heater. After passing through the water-to-water feedwater heater, the feedwater would then pass serially through two high pressure feedwater heaters in which the highest pressure feedwater heater condensate would be introduced into the next highest pressure feedwater heater. The condensate from this feedwater heater would then be introduced directly into the feedwater stream.

BRIEF DESCRIPTION OF THE DRAWINGS

The present invention will be more fully understood by a reading of the description of the preferred embodiment in conjunction with the drawing, in which.

DESCRIPTION OF THE PREFERRED EMBODIMENT

The present invention relates generally to steam turbine power plant systems and, more particularly, to a configuration of feedwater heaters which are associated with a heat exchanger.

Figure 1:
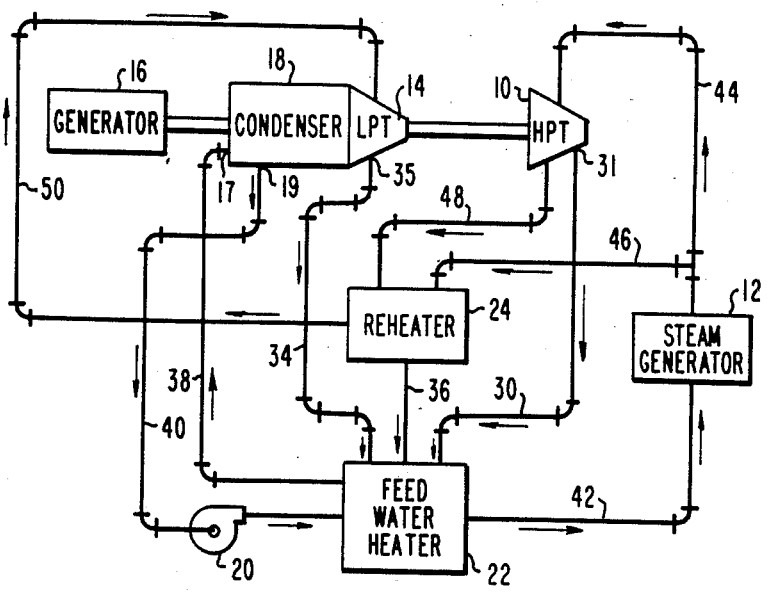
FIG. 1 illustrates an exemplary schematic of a steam turbine power plant.

FIG. 1 illustrates a schematic view of a nuclear steam power plant which comprises a high pressure turbine element 10 which is supplied with steam at high pressure and high temperature from a steam generator 12. The steam expands through the high pressure turbine element 10 and then passes through a lower pressure turbine element 14 in order to convert the energy which is carried by the motive fluid into mechanical energy which produces electricity by rotating the generator 16. After expanding through the turbine elements within the power plant, the steam is returned to the liquid state in a condenser 18. The condensate from the condenser 18 is then returned to the primary steam generator 12.

A feed pump 20 is used to force condensate from the condenser 18 into a feedwater heater system 22. The feedwater heater 22 increases the efficiency of the steam turbine power plant by raising the temperature of the condensate which is pumped into the steam generator 12 by the feed pump 20. This condensate has a temperature upon discharge from the feedwater heater 22 which is higher than the temperature of the condensate as it is introduced into the feedwater heater 22 by the feed pump 20.

In order to further increase the efficiency of the power plant, the high pressure turbine exhaust flow is dried within a moisture separator and then reheated within a reheater 24 which is disposed between the high pressure turbine 10 and the low pressure turbine 14. The reheating is accomplished through the use of steam which is taken from the throttle of the high pressure turbine 10 and used alone or in conjunction with partially expanded steam from the high pressure turbine 10.

The feedwater heater 22 derives its heating source from an extraction port on the high pressure turbine element 10. When a plurality of feedwater heaters are utilized, some of the feedwater heaters can derive their heating source from extraction ports on both high 10 and low 14 pressure turbine elements.

In FIG. 1, the high pressure elements of the feedwater heater system 22 are provided with a heating source from the high pressure extraction line 30 which is connected to an extraction port 31 on the high pressure turbine element 10. Similarly, the low pressure elements of the feedwater heater system 22 are provided with a heating source from extraction line 34 which is connected to an extraction port 35 on the low pressure turbine element 14.

The feedwater heater system 22 is also provided with a heating source from a drain line 36 which carries drain water from the separator of a moisture separator-reheater 24 to the feedwater heater system 22. After the high temperature fluid, which is received from lines 30, 34 and 36, is used to raise the temperature of feedwater in the feedwater heater system 22, it passes to the condenser 18 through line 38. This fluid, whose temperature has been reduced by passing through the feedwater heaters, is then completely condensed in the condenser and enters the stream of feedwater which is eventually superheated in the steam generator 12.

The feedwater itself passes from the condenser 18 to the feedwater heater system 22 through line 40. As this feedwater passes through the feedwater heater system 22, its temperature is significantly raised by the transfer of heat from the various heating sources within the feedwater heater system 22 described above. The feedwater then passes from the feedwater heater system 22, through line 42, into the steam generator 12, where it is vaporized and often superheated before passing into the high pressure turbine element 10 through line 44. A portion of this superheated steam can also be conducted to the reheater 24 through line 46. The reheater 24, which is typically a moisture separator-reheater, also receives steam from the high pressure turbine element through line 48. The reheating of steam, which occurs in the reheater 24, is accomplished through the use of high pressure steam taken from the throttle of the high pressure turbine 10, and after having most of its moisture removed, is introduced into the low pressure turbine element 14 through line 50. It should be understood that the configuration illustrated in FIG. 1 is exemplary and that other alternative configurations are possible. It should further be understood that the feedwater heater system 22, which is illustrated in FIG. 1, generally comprises a plurality of individual feedwater heater elements.

Figure 2:
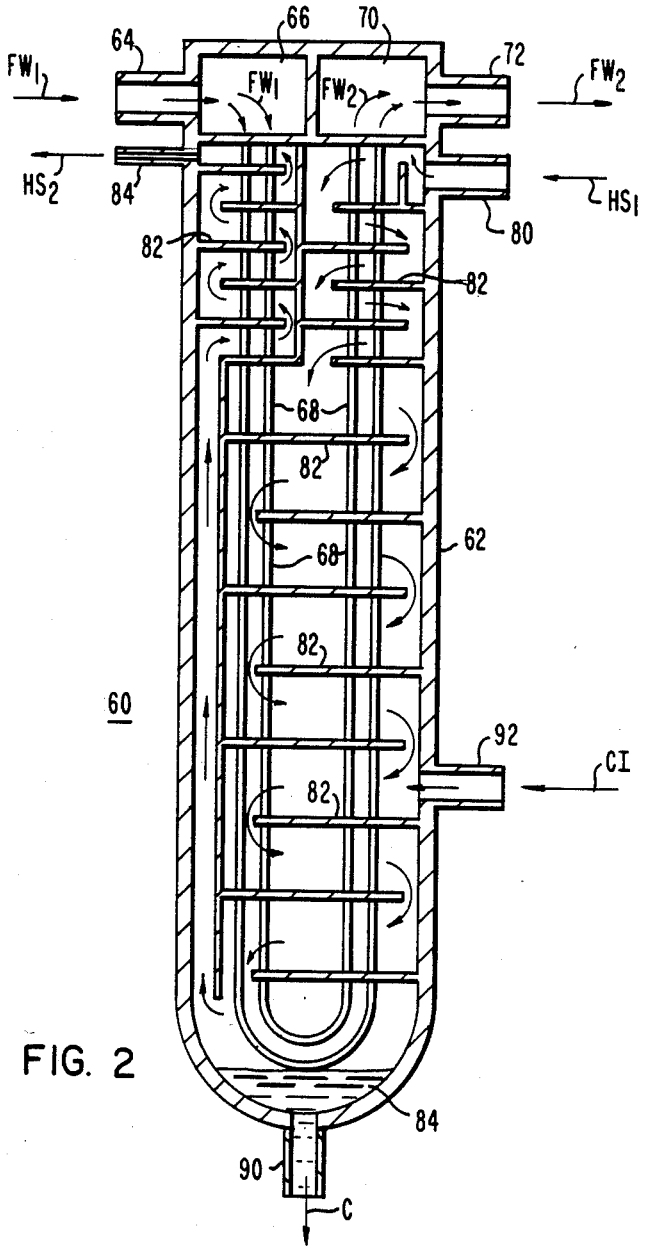
FIG. 2 shows the internal configuration of a typical feedwater heater.

FIG. 2 illustrates an exemplary feedwater heater 60. Although many different types of feedwater heaters are known to those skilled in the art, the feedwater heater 60, which is illustrated in FIG. 2, is illustrative of the basic components utilized in most types of feedwater heaters.

As illustrated in FIG. 2, the feedwater heater 60 comprises a shell 62 which contains its heat exchange components. A feedwater inlet pipe 64 permits a flow of feedwater, indicated by arrow $FW_1$, to enter a chamber 66 of the feedwater heater 60. From the inlet chamber 66, the feedwater passes into and through the central bore of a plurality of U-shaped tubes 68. These tubes 68 are disposed within the shell 62 in such a way that they are placed in thermal communication with a quantity of heating steam. After passing through the tubes 68, the feedwater enters an outlet chamber 70 before leaving the feedwater heater 60 through a feedwater outlet pipe 72 as indicated by arrows $FW_2$.

The heating source steam enters the shell 62 of the feedwater heater 60 through an inlet port 80 as indicated by arrows $HS_1$. This steam then flows around a plurality of baffles 82. The purpose of the baffles 82 is to force the heating steam to pass in prolonged thermal relation with the tubes 68. This prolonged thermal relation improves the heat transfer from the heating steam to the feedwater which is passing through the internal bore of the U-shaped tubes 68. As the heat is transferred from the heating steam to the tubes and the feedwater flowing therein, a portion of the heating steam thereby condenses to form a condensate 84 which flows, under the influence of gravity, toward the bottom portion of the heat exchanger 60. After passing in thermal communication with the plurality of U-shaped tubes 68, the heating steam then exits from the shell 62 of the feedwater heater 60 through an outlet port 84 as indicated by arrow $HS_2$.

The condensate 84 is removed from the feedwater heater 60 through a condensate outlet 90 at the bottom portion of the feedwater heater 60 as indicated by arrow C. It should be understood that, although the condensate 84 is at a lower temperature than the original steam which entered through inlet 80, their pressures are essentially identical.

Also shown in FIG. 2 is an inlet 92 through which a fluid can enter the shell 62 of the feedwater heater 60 as indicated by arrow CI. Through this inlet port 92, the condensate from another, higher pressured, feedwater heater can be introduced into the shell 62 of the feedwater heater 60. This condensate, which is typically in a liquid state, is at a higher pressure than the steam passing within the shell 62 of the feedwater heater 60. Therefore, the condensate input indicated by arrow CI will tend to flash into a vapor form as it enters the feedwater heater 60 illustrated in FIG. 2. Since the condensate of a higher pressure feedwater heater is at a higher temperature than the feedwater, it can be used to raise the temperature of the feedwater as it passes through the U-shaped tubes 68. Furthermore, since the condensate input, as illustrated by arrow CI, is at a higher pressure than the heating source steam passing around the baffles 82 of the feedwater heater 60, it will tend to flow into the shell 62 and combine with the heating steam.

Figure 3:
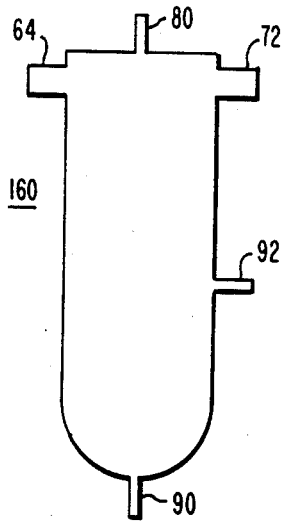
FIG. 3 shows a simplified symbolic representation of a feedwater heater used throughout FIGS. 4–8.

FIG. 3 illustrates a simplified symbolic representation of the feedwater heater 60 of FIG. 2. Throughout the description of the preferred embodiment of the present invention, the symbolic representation 160 will be used to represent a typical vapor-to-liquid feedwater heater. By comparing FIGS. 2 and 3, the symbolic representation of a feedwater heater 160 and its major components can be more easily understood. The symbolic representation of the feedwater heater 160 is a simplified representation of the feedwater heater 60 of FIG. 2, showing only its major components which are relevant to a discussion of the present invention.

In FIG. 3, the feedwater heater 160 is shown with its feedwater inlet 64 and feedwater outlet 72 extending from its main structure. The vapor inlet 80 is shown extending from the top of the feedwater heater 160. This vapor inlet is generally connected in fluid communication with an extraction port of either the high pressure or low pressure turbine elements or the drain line from a reheater. The condensate outlet 90 is shown extending downward from the bottom of the feedwater heater 160. This condensate outlet 90 permits the removal of liquid condensate from the feedwater heater 160 and is generally connected in fluid communication with either another feedwater heater or with the inlet of a condenser. Inlet 92 represents the port through which a condensate from another feedwater heater can be introduced into the feedwater heater 160. As discussed above, this condensate liquid would typically flash into a vapor as it enters the shell of the feedwater heater 160 through the inlet 92. It should be understood that some uses of the symbolic representation of the feedwater heater 160 will not incorporate an inlet 92. When a feedwater heater 160 is the highest pressure feedwater heater of a system, the inlet 92 is not utilized since no feedwater heater could supply a condensate at a higher pressure than that within the shell of the highest pressure feedwater heater 160.

Figure 4:
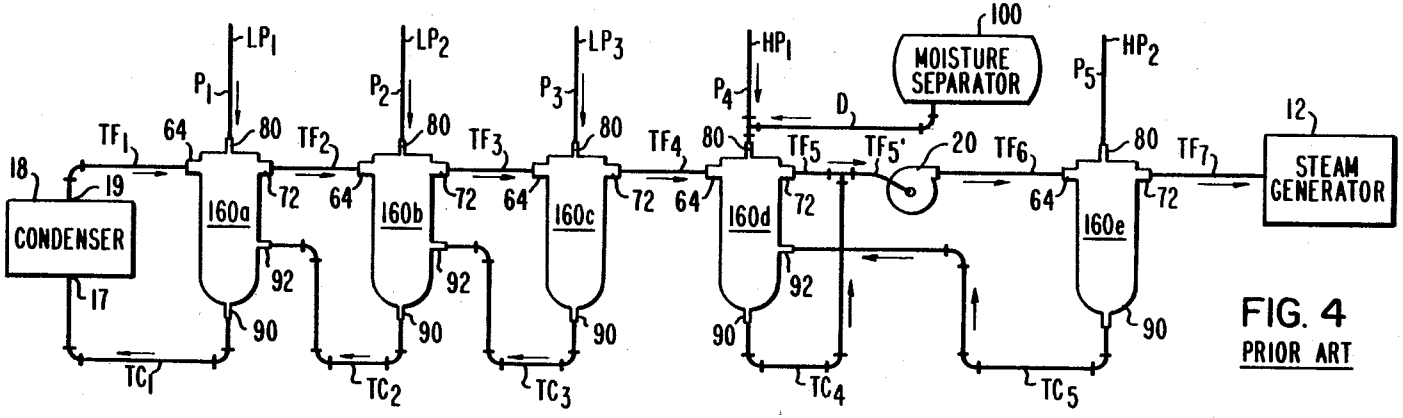
FIG. 4 PRIOR ART
FIGS. 4, 5 and 6 illustrate typical steam turbine feedwater heater configurations known to those skilled in the art.

FIG. 4 illustrates a typical configuration of a plurality of feedwater heaters, 160*a*–160*e*, associated with a moisture separator-reheater 100 and a feedwater pump 20. It should be understood that the condenser 18, a steam generator 12 and a steam turbine (not shown in FIGS. 4–8), with both high and low pressure turbine elements, are associated with the feedwater heater system illustrated in FIG. 4 in a manner similar to that described above and shown in FIG. 1.

In a configuration such as the one illustrated in FIG. 4, the feedwater passes serially through feedwater heaters 160*a*–160*d*, through the feedwater pump 20 and then through feedwater heater 160*e* before passing into the steam generator 12. The feedwater inlet port of feedwater heater 160*a* is connected in fluid communication with an outlet port 19 of the condenser 18 and the vapor inlet 80 of feedwater heater 160*a* is connected to an extraction port $LP_1$ of a low pressure turbine element. The condensate outlet 90 of the first feedwater heater 160*a* is connected in fluid communication with an inlet port 17 of the condenser 18. In order to better illustrate the thermodynamic relationships of the components illustrated in FIG. 4, the pressures and temperatures of selected points within the fluid circuit of FIG. 4 have been labeled with reference numerals $P_1$–$P_5$, $TF_1$–$TF_7$ and $TC_1$–$TC_5$, which represent the pressures, feedwater temperatures and condensate temperatures, respectively. As can be seen in FIG. 4, the exemplary illustration comprises three low pressure extraction ports $LP_1$–$LP_3$ and two high pressure extraction ports, $HP_1$ and $HP_2$. In order to more clearly illustrate the thermodynamic relationships of the components of the exemplary feedwater heater system illustrated in FIG. 4, the following table lists the values of the relevant pressures and temperatures of selected points throughout the system.

| LOCATION | PRESSURE (psia) |
|---|---|
| $P_1$ | 9 |
| $P_2$ | 21 |
| $P_3$ | 54 |
| $P_4$ | 211 |
| $P_5$ | 382 |
| **LOCATION** | **TEMPERATURE (°F.)** |
| $TF_1$ | 126 |
| $TF_2$ | 183 |
| $TF_3$ | 225 |
| $TF_4$ | 281 |
| $TF_5$ | 381 |
| $TF_{5'}$ | 380 |
| $TF_6$ | 382 |
| $TF_7$ | 435 |
| $TC_1$ | 141 |
| $TC_2$ | 198 |
| $TC_3$ | 240 |
| $TC_4$ | 376 |
| $TC_5$ | 397 |

The configuration illustrated in FIG. 4 illustrates a typical connection scheme, known to those skilled in the art, using five feedwater heaters. The first three feedwater heaters, 160*a*–160*c*, are connected to the extraction ports, $LP_1$–$LP_3$, of low pressure turbine elements. Feedwater heater 160*c* has its condensate outlet 90 connected in fluid communication with an inlet 92 of feedwater heater 160*b*. As this condensate passes into feedwater heater 160*b*, its higher pressure causes it to flash from a liquid to a gaseous state. It should be noted that, since the temperature of the condensate leaving feedwater heater 160*c* is higher than the temperature of the feedwater entering feedwater heater 160*b*, the efficiency of the overall turbine system can be improved by using this condensate to further aid in heating the feedwater as it passes through feedwater heater 160*b*. For this reason, it is economically beneficial to cascade the condensate from feedwater heaters backward toward the inlet of the condenser in a direction opposite to that of the feedwater flow. Similarly, the condensate from feedwater heater 160*b* is cascaded into feedwater heater 160*a* for the reasons discussed above. Eventually, the condensate from the lowest pressure feedwater heater 160*a* is connected in fluid communication with an inlet port 17 of the condenser 18 and this condensate is further condensed and prepared for reentry into the stream of feedwater which would then begin this path again by entering the feedwater inlet 64 of feedwater heater 160*a*.

As can be seen in FIG. 4, the condensate outlet 90 of feedwater heater 160*d* is not cascaded backward toward the condenser. Instead, it is connected in fluid communication with the feedwater line. Therefore, the resulting condensate from the fluids received from the high pressure extraction port $HP_1$ and the separator drain D of the moisture separator-reheater 100 is not cascaded back toward the condenser, but, instead, is introduced into the flow of feedwater which is moving toward the steam generator 12. Also, since the condensate outlet 90 of feedwater heater 160*e* is connected to an inlet 92 of feedwater heater 160*d*, the resulting condensate from the steam received from high pressure extraction port $HP_2$ also eventually enters the stream of feedwater which flows into the steam generator 12.

The configuration of feedwater heaters, 160*a*–160*e*, which is illustrated in FIG. 4 is known to those skilled in the art and represents a thermodynamically sound arrangement of components. It cascades the condensate from the feedwater heaters, 160*a*–160*c*, which are connected to the low pressure extraction ports, $LP_1$–$LP_3$, in a direction back toward the condenser. The feedwater heaters, 160*d*–160*e*, which are connected to the high pressure extraction ports, $HP_1$–$HP_2$, along with the separator drain D from the moisture separator-reheater 100, are eventually introduced into the feedwater stream and pass into the steam generator 12. Although achieving good thermodynamic results, the configuration illustrated in FIG. 4 reduces the overall reliability of the steam turbine system.

The reliability of the steam turbine system will be reduced because, in the configuration illustrated in FIG. 4, the water from the separator drain D of the moisture separator-reheater 100 which flows into the feedwater heater 160*d* would have a much higher level of contaminants than the steam received from the high and low pressure extraction ports, $HP_1$, $HP_2$, $LP_1$–$LP_3$. Since this fluid is not purified in the condensate demineralizers, it successively increases the contaminant levels in the condensate entering the steam generator 12 and the steam leaving the steam generator 12 which passes to the turbine.

Figure 5:
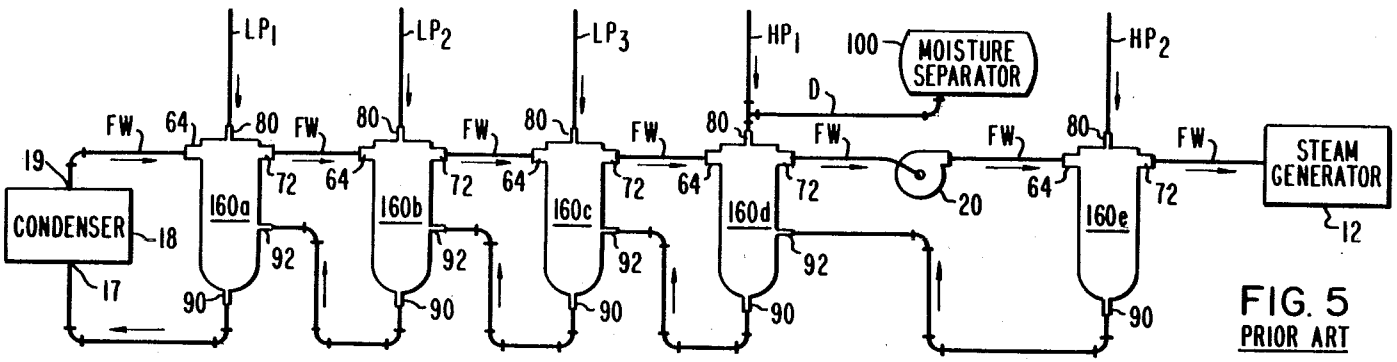
FIG. 5 PRIOR ART

FIG. 5 illustrates another configuration of feedwater heaters known to those skilled in the art. The difference between the configurations illustrated in FIGS. 4 and 5 is primarily in the interconnection of the components. For example, the condensate from all of the feedwater heaters, 160*a*–160*e*, of FIG. 5 is cascaded back to lower pressure feedwater heaters and the lowest feedwater heater 160*a* has its condensate outlet 90 connected in fluid communication with an inlet port 17 of the condenser 18. Therefore, none of the condensate from the feedwater heaters is directly connected into the stream of feedwater which is illustrated by arrows FW. It should be understood that the pressures and temperatures at points within the configuration illustrated in FIG. 5 are generally equivalent to the pressures and temperatures at similar points in FIG. 4.

The configuration of feedwater heaters which is illustrated in FIG. 5 represents a feedwater heater system which has an extremely high reliability, but which suffers from an unacceptably low thermodynamic efficiency. This loss in the thermodynamic efficiency, or heat rate, reduces the output of the power plant by at least 0.4% and will result in an economic penalty of millions of dollars in a typical steam turbine power plant. Furthermore, the increase in drain flows to the feedwater heaters and the increased condensate flow through the low pressure feedwater heaters may be beyond the capacity of these feedwater heaters when the steam cycle is modified in an existing power plant to achieve the configuration illustrated in FIG. 5.

Figure 6:
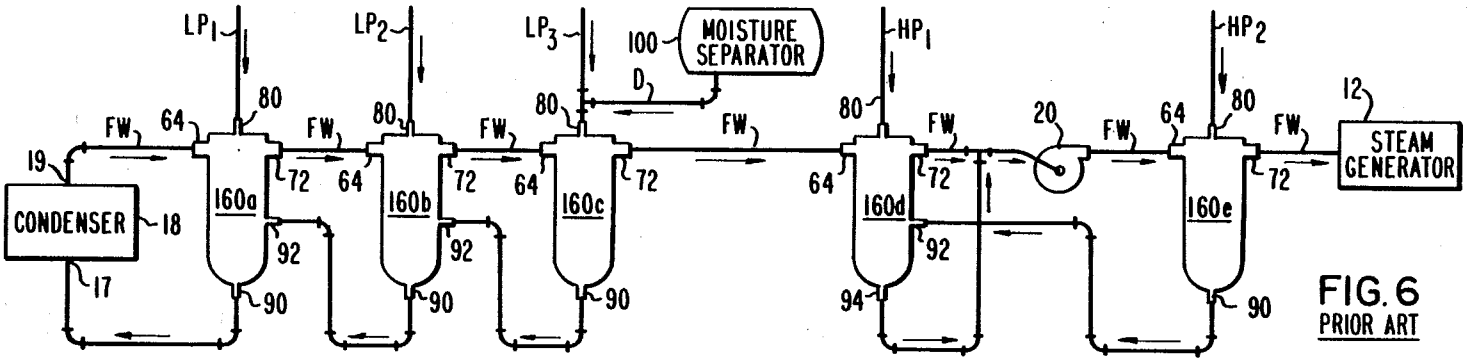
FIG. 6 PRIOR ART

The configuration of feedwater heaters which is illustrated in FIG. 6 also represents an alternative configuration which is known to those skilled in the art. As in FIGS. 4 and 5, the feedwater heater configuration illustrated in FIG. 6 incorporates three low pressure feedwater heaters, 160*a*–160*c*, which receive steam from low pressure extraction ports, $LP_1$–$LP_3$, and their condensates are cascaded back toward a condenser 18. Similarly to FIG. 4, the configuration in FIG. 6 also incorporates two high pressure feedwater heaters, 160*d*–160*e*, which are connected to the extraction ports, $HP_1$ and $HP_2$, of high pressure turbine elements, and the condensate from these two feedwater heaters, 160*d* and 160 *e*, are eventually introduced into the feedwater line which passes the feedwater toward the steam generator 12.

A significant difference between the configurations illustrated in FIGS. 4 and 5 and the configuration shown in FIG. 6 is that the separator drain D of the moisture separator-reheater 100 is connected to the vapor inlet 80 of one of the low pressure feedwater heaters 160*c*. This type of connection scheme illustrates a compromise between the two schemes described above and illustrated in FIGS. 4 and 5. The moisture separator-reheater 100 in FIG. 6 has its separator drain D connected to a feedwater heater 160*c* which eventually will cascade that fluid back to the condenser 18 instead of introducing that fluid into the feedwater line which will eventually flow into the steam generator 12. However, the connection scheme illustrated in FIG. 6 directs the condensate from the two high pressure feedwater heaters, 160*d* and 160*e*, into the feedwater line. The output loss which would result from the steam cycle illustrated in FIG. 6 is slightly less than that of FIG. 5. Since the contaminated fluid which passes from the separator drain cascades to the condenser, feedwater purity and reliability are enhanced. Also, the condensate and drain flows through the feedwater heaters, 160*a*–160*c*, are not increased as much as the steam cycle illustrated in FIG. 5 and described above. In the design of steam turbine power plants, the choice between reliability and heat rate must inevitably be decided in favor of improved reliability which can be achieved by the reduction in contaminants flowing to the steam generator 12.

Figure 7:
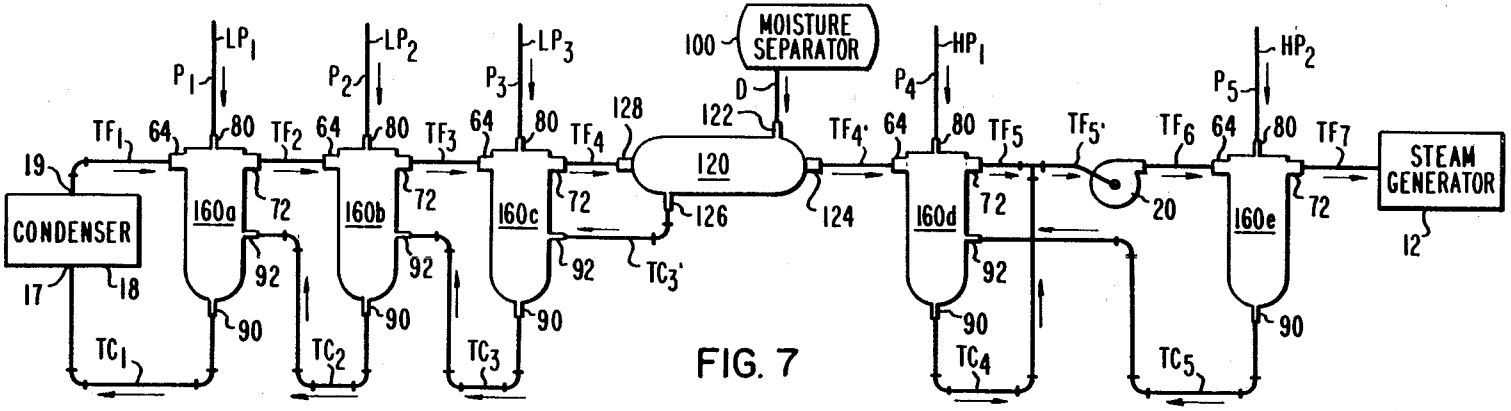
FIG. 7 illustrates an embodiment of the present invention.

A preferred embodiment of the present invention is illustrated in FIG. 7. It incorporates five feedwater heaters, 160*a*–160*e*, in conjunction with a moisture separator-reheater 100 and a condenser 18 and a steam generator 12. This embodiment of the present invention, as illustrated in FIG. 7, utilizes three low pressure feedwater heaters, 160*a*–160*c*, which are connected to extraction ports, $LP_1$–$LP_3$, of low pressure turbine elements. The condensate outlets 90 of these three low pressure feedwater heaters are cascaded back towards a condenser 18 as shown. Two high pressure feedwater heaters, 160*d* and 160*e*, are connected to the extraction ports, $HP_1$ and $HP_2$, of the high pressure turbine elements. As further illustrated in FIG. 7, the highest pressure feedwater heater 160*e* has its condensate outlet 90 connected in fluid communication with an inlet 92 of the next highest high pressure feedwater heater 160*d*. This next highest feedwater heater 160*d* has its condensate outlet 90 connected in fluid communication with the feedwater stream as shown. The configuration of the present invention, as illustrated in FIG. 7, further incorporates a liquid-to-liquid heat exchanger 120 which is connected in series between feedwater heaters 160*c* and 160*d*. This liquid-to-liquid heat exchanger operates essentially as a drain cooler and has a drain inlet 122 connected to the separator drain D of the moisture separator-reheater 100. A drain outlet 126 of the drain cooler 120 is connected in fluid communication with an inlet 92 of feedwater heater 160*c* which operates at the highest pressure of the three low pressure feedwater heaters, 160*a*–160*c*. The drain cooler 120 has a feedwater outlet 124 and a feedwater inlet 128 which enables it to be connected in series with the five feedwater heaters, 160*a*–160*e*, as shown. With the liquid-to-liquid heat exchanger 120 interspersed between the lowest high pressure feedwater heater 160*d* and the highest low pressure feedwater heater 160*c*, it has been determined that the heat rate is improved by approximately 0.31% as compared with the alternative configuration, illustrated in FIG. 5, where all feedwater heaters are cascaded back to the condenser 18. In a configuration within the scope of the present invention, the liquid-to-liquid heat exchanger 120 would receive the water from the drain D of the moisture separator-reheater 100 and would cascade this condensate back to feedwater heater 160*c* and, eventually, to the condenser 18. The liquid-to-liquid feedwater heater 120, in this type of application, acts essentially similar to a drain cooler.

It is recognized that the configuration illustrated in FIG. 7 would exhibit a heat cycle with a heat rate which is approximately 0.12% poorer than that of the configuration illustrated in FIG. 4. However, the preferred embodiment of the present invention, as illustrated in FIG. 7, is not subject to the impurity concentrations of the scheme illustrated in FIG. 4. Of special importance in the configuration illustrated in FIG. 7 is the fact that the changes in drain and condensate flow of the configurations illustrated in FIGS. 6 and 7 are approximately the same while the heat rate of FIG. 7 is approximately 0.25% lower than the heat rate of the configuration illustrated in FIG. 6.

The present invention avoids the impurity concentrating mechanisms of alternative configurations, such as the one illustrated in FIG. 4, while minimizing the loss of heat rate as compared to other impurity minimizing connection schemes. A further advantage of the present invention is that it can be utilized as a retrofit for existing steam turbine power plants whereas the configuration illustrated in FIG. 5, in all probability, cannot. It should be apparent that if a present steam turbine power plant is retrofitted in accordance with the configuration illustrated in FIG. 5, the condensate flow which would be experienced by the condenser 18 and the lower pressure feedwater heaters, 160*a*–160*c*, would be significantly increased. However, the present invention, as illustrated in FIG. 7, can be applied as a retrofit to existing steam turbine power plants with a much less significant increase in condensate flow experienced by the low pressure feedwater heaters, 160*a*–160*c*, and the condenser 18. The alternative known configuration illustrated in FIG. 6 would also have a very slight increase in the condensate flow to the low pressure feedwater heaters, but would also increase the heat rate of the steam turbine cycle by an amount which is approximately 0.24% worse than the present invention as illustrated in FIG. 7.

In any configuration of feedwater heaters used in conjunction with a moisture separator-reheater 100, a condenser 18 and a steam generator 12, two conflicting criteria must be considered. First, the effect of the configuration on the heat rate of the steam turbine cycle, and the relative cost of this effect, must be weighed. Also, the overall reliability of the system can be seriously affected by the introduction of potential deposits of impurities, such as sodium chloride, into the feedwater stream. These deposits can collect in the steam generator 12 and cause corrosion damage to its internal heat exchanger tubes with a resulting deleterious affect on overall system reliability. In general, the steam cycle of a steam turbine system is negatively affected in proportion with the amount of condensate fluid which is cascaded back towards the condenser 18. Similarly, the purity of the feedwater is negatively affected in relationship with the amount of condensate which is caused to flow into the feedwater as it passes towards the steam generator 12. It is believed that the present invention, as illustrated in FIG. 7, is an improvement over existing systems, known to those skilled in the art, as measured by both of these criteria. It increases the reliability of the steam turbine system by minimizing the deposits which enter the feedwater stream and also minimizes the negative affect on the heat rate of the total steam turbine system.

The primary distinction between the liquid-to-liquid heat exchanger 120 and the other feedwater heaters, 160*a*–160*e*, which are illustrated in FIG. 7, is that the liquid-to-liquid heat exchanger 120, or drain cooler, receives an input of liquid at its drain inlet 122 and this liquid remains in a liquid state as its heat is transferred to the feedwater prior to the exit of this liquid from outlet 126. In comparison, the feedwater heaters, 160*a*–160*e*, receive inputs from the low and high pressure elements of the turbine system and from other feedwater heaters which are either initially in the gaseous state or which flash to the gaseous state upon entry into the feedwater heater's shell. By avoiding the flashing or throttling of the separator drain D of the moisture separator-reheater 100 which enters the liquid-to-liquid heat exchanger 120 in FIG. 7, the condensate leaving these heat exchanger can achieve a higher temperature than would be possible if the drain water was flashed. This results in a higher water temperature entering the feedwater heater 160*d* and therefore increases the steam cycle efficiency of the configuration illustrated in FIG. 7 as compared to its alternatives which do not utilize a liquid-to-liquid heat exchanger. The flashing of the drain water as it enters the feedwater heaters reduces the maximum temperature to which these fluids can heat the feedwater.

Figure 8:
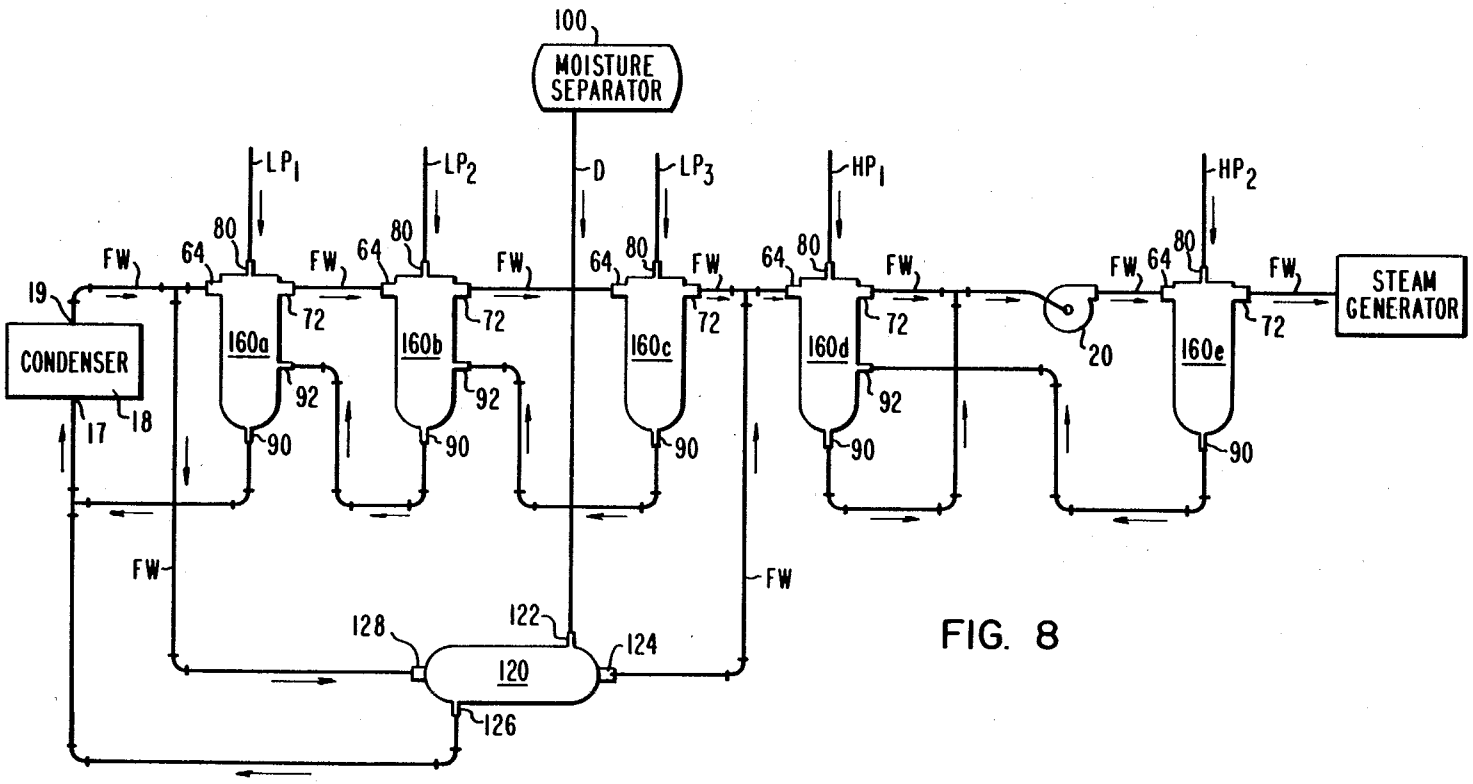
FIG. 8 illustrates an alternative embodiment of the present invention.

An alternate embodiment of the present invention is illustrated in FIG. 8. It is similar to the embodiment illustrated in FIG. 7 in all respects except that the liquid-to-liquid heat exchanger 120, or drain cooler, is connected hydraulically in parallel with the three low pressure feedwater heaters, 160*a*–160*c*. The drain cooler 120 receives feedwater through its feedwater inlet 128 and discharges this feedwater through its feedwater outlet 124 to a point in the feedwater line between the highest low pressure feedwater heater 160*c* and the lowest high pressure feedwater heater 160*d*. It receives water from the drain D of the moisture separator-reheater 100 in its drain inlet 122 and exhausts this fluid from its outlet 126 toward the condenser 18. Since the feedwater entering the feedwater inlet 128 in the configuration illustrated in FIG. 8 is at a lower temperature than the feedwater entering the feedwater inlet 128 in the configuration illustrated in FIG. 7, there is a much greater temperature differential between the drain water from the moisture separator-reheater 100 and the incoming feedwater. Due to this increased differential in temperature, the heat exchange characteristics of the drain cooler 120 are different from that experienced in the configuration of FIG. 7.

The advantage of the arrangement illustrated in FIG. 8 is that the moisture separator-reheater drain D does not mix with the drains from the lower pressure feedwater heaters, 160*a*–160*c*. The heat rate of the configuration in FIG. 8 is approximately 0.33% lower than that of the configuration illustrated in FIG. 7. However, the log mean temperature difference of the drain cooler 120 in FIG. 8 is approximately one-fourth that of the drain cooler 120 in FIG. 4. This characteristic would require approximately four times as much heat transfer surface within the drain cooler 120. With a 15° F. drain terminal difference of the liquid-to-liquid heat exchanger 120 of FIG. 8, the heat rate is approximately 0.02% poorer than that of the configuration which is illustrated in FIG. 7. In this case, the log mean temperature difference of the drain cooler 120 in FIG. 8 is still smaller, by a factor of approximately 2.6, than the drain cooler of FIG. 7.

The present invention provides a feedwater heater configuration which employs a liquid-to-liquid heat exchanger in addition to a plurality of feedwater heaters in order to minimize negative affects on the overall heat rate of a steam turbine power plant while reducing the amount of potential impurity concentration within the feedwater circuit. An overall improvement in the reliability of a steam turbine power plant can therefore be achieved by the present invention with a lesser deleterious affect on heat rate than is possible with alternative configurations presently known to those skilled in the art. Although the present invention has been described in considerable detail and has been illustrated with particular specificity, it should be understood that other embodiments of the present invention are within its scope.

What I claim is:

1. A steam turbine power plant, comprising:

A low pressure turbine element having a first extraction point;

a high pressure turbine element having a second extraction point;

a condenser having an inlet port and an outlet port;

a steam generator having an inlet port, said inlet port of said steam generator being connected in fluid communication with said outlet port of said condenser;

a first feedwater heater connected in fluid communication between said outlet port of said condenser and said inlet port of said steam generator, said first feedwater heater having a vapor inlet connected in fluid communication with said first extraction port of said low portion turbine element, said first feedwater heater having a condensate outlet connected in fluid communication with said inlet port of said condenser;

a second feedwater heater connected in fluid communication between said first feedwater heater and said inlet port of said steam generator, said second feedwater heater having a vapor inlet connected in fluid communication with said second extraction port of said high pressure turbine element, said second feedwater heater having a condensate outlet connected in fluid communication with said inlet port of said steam generator;

a third feedwater heater connected in fluid communication between said outlet port of said condenser and said second feedwater heater, said third feedwater heater being connected in parallel with said first feedwater heater, said third feedwater heater having an inlet port and an outlet port, said outlet port of said third feedwater heater being connected in fluid communication with said inlet port of said condenser;

a reheater having a drain outlet connected in fluid communication with said inlet of said third feedwater heater; and whereby feedwater can flow sequentially from said outlet port of said condenser, through said first feedwater heater, through said second feedwater heater and to said inlet port of said steam generator with a parallel path from said outlet port of said condenser, through said third feedwater heater, through said second feedwater heater to said inlet port of said steam generator.

2. The steam turbine power plant of claim 1, wherein: said reheater is a moisture separator-reheater.

3. The steam turbine power plant of claim 2, further comprising:

a fourth feedwater heater connected in fluid communication between said outlet port of said condenser and said first feedwater heater, said fourth feedwater heater having a vapor inlet connected in fluid communication with a third extraction port of said low pressure turbine element, said fourth feedwater heater having a condensate outlet connected in fluid communication with said inlet port of said condenser, said fourth feedwater heater having an inlet port connected in fluid communication with said condensate outlet port of said first feedwater heater, said fourth feedwater heater being connected hydraulically in series with said first and second feedwater heaters and hydraulically in parallel with said third feedwater heater.

4. The steam turbine power plant of claim 3, further comprising:

a fifth feedwater heater connected in fluid communication between said second feedwater heater and said inlet port of said steam generator said fifth feedwater heater having a vapor inlet connected with a fourth extraction port of said high pressure turbine element, said fifth feedwater heater having a condensate outlet connected in fluid communication with an inlet port of said second feedwater heater.

5. The steam turbine power plant of claim 4, further comprising:

a sixth feedwater heater connected in fluid communication between said outlet port of said condenser and said fourth feedwater heater, said sixth feedwater heater having a vapor inlet connected in fluid communication with a fifth extraction port of said low pressure turbine element, said sixth feedwater having a condensate outlet connected in fluid communication with said inlet port of said condenser, said sixth feedwater heater having an inlet connected in fluid communication with said condensate outlet of said fourth feedwater heater, said sixth feedwater heater being connected hydraulically in series with said first, second and fourth feedwater heaters and hydraulically in parallel with said third feedwater heater.

* * * * *